US012768534B2

(12) United States Patent
Joos et al.

(10) Patent No.: US 12,768,534 B2
(45) Date of Patent: Oct. 20, 2026

(54) PORTABLE SYSTEM FOR CONVERTING LIQUID OXYGEN (LOX) TO OXYGEN GAS FOR THE SUSTAINMENT OF HIGH-VOLUME TORCH CUTTING

(71) Applicant: Broco, Inc., Ontario, CA (US)

(72) Inventors: Thomas Conrad Joos, Ontario, CA (US); Trevor Manning, Riverside, CA (US); Stan Wilkison, Lake Forest, CA (US)

(73) Assignee: Broco, Inc., Ontario, CA (US)

( * ) Notice: Subject to any disclaimer, the term of this patent is extended or adjusted under 35 U.S.C. 154(b) by 392 days.

(21) Appl. No.: 18/516,061

(22) Filed: Nov. 21, 2023

(65) Prior Publication Data

US 2024/0295319 A1 Sep. 5, 2024

Related U.S. Application Data

(60) Provisional application No. 63/384,690, filed on Nov. 22, 2022.

(51) Int. Cl.
*F23D 14/42* (2006.01)
*F23D 14/46* (2006.01)
(Continued)

(52) U.S. Cl.
CPC ..... *F23D 14/42* (2013.01); *F23D 14/66* (2013.01); *F23D 14/465* (2013.01); *F23D 14/72* (2013.01); *F23D 2208/10* (2013.01)

(58) Field of Classification Search
CPC ..... F23D 14/42; F23D 14/66; F23D 14/465; F23D 14/72; F23D 2208/10
(Continued)

(56) References Cited

U.S. PATENT DOCUMENTS 4,045,189 A * 8/1977 Bruni ..... C10L 3/02 48/190
4,995,918 A * 2/1991 Grohmann ..... B23K 7/00 148/194

(Continued)

FOREIGN PATENT DOCUMENTS

CN 1092143 * 9/1994 ..... F23D 14/42
JP S62165088 * 10/1987 ..... F23D 14/42
JP H08118058 * 5/1996 ..... F23D 14/42

OTHER PUBLICATIONS

JPS62165088 (Year: 1987).*

(Continued)

*Primary Examiner* — Jessee R Roe
*Assistant Examiner* — Michael Aboagye
(74) *Attorney, Agent, or Firm* — Kevin Schraven; Anooj Patel; Hankin Patent Law, APC

(57) ABSTRACT

A modular transportable oxy-fuel cutting device, comprising: liquid oxygen containers; vaporizers; and a cutting torch. The liquid oxygen containers, vaporizers, and the cutting torch are all in fluidic communication with each other through a series of pipes. The liquid oxygen containers are configured to contain a liquid oxygen fluid and supply the liquid oxygen fluid to the vaporizers; wherein the vaporizers are configured to convert the liquid oxygen fluid to an oxygen gas; and the cutting torch is adapted to accept the oxygen gas and a fuel gas.

17 Claims, 6 Drawing Sheets

(51) Int. Cl.
*F23D 14/66* (2006.01)
*F23D 14/72* (2006.01)

(58) Field of Classification Search
USPC ..... 266/48, 160; 148/194
See application file for complete search history.

(56) References Cited

U.S. PATENT DOCUMENTS

| | | | | |
|---|---|---|---|---|
| 8,402,965 | B1 * | 3/2013 | Scharfenberg | A61M 16/10 128/201.21 |
| 11,110,535 | B2 * | 9/2021 | Roubicek | F23D 14/42 |
| 2009/0200714 | A1 * | 8/2009 | Moon | B23K 7/10 266/69 |

OTHER PUBLICATIONS

JPH08118058, Karasaki et al., Torch for Laser Machining and Laser Beam Machine, May 14, 1996 (Year: 1996).*
CN1092143, Shi, Portable Oxygen Tank For Storing Oxygen Welding, Sep. 14, 1994 (Year: 1994).*

* cited by examiner

PORTABLE SYSTEM FOR CONVERTING LIQUID OXYGEN (LOX) TO OXYGEN GAS FOR THE SUSTAINMENT OF HIGH-VOLUME TORCH CUTTING

CROSS-REFERENCE TO RELATED APPLICATIONS

This U.S. Utility Non-Provisional Patent Application, takes priority from U.S. Provisional Patent Application No. 63/384,690, filed on Nov. 22, 2022, titled Portable System For Converting Liquid Oxygen (Lox) To Oxygen Gas For The Sustainment Of High-Volume Torch Cutting, the contents of which are expressly incorporated herein by this reference as though set forth in their entirety and to which priority is claimed.

FIELD OF USE

The present disclosure relates to a modular and transportable liquid oxygen exothermic cutting device. More specifically, the present disclosure relates to a transportable exothermic cutting device for cutting operations that require high-volume flow rates.

BACKGROUND

Liquid oxygen ("LOX") for cutting torches has a multitude of uses, many of which are in industrial environments such as demolition and salvage. LOX is preferred for such purposes because the supply tanks support long extended cutting jobs and eliminate the need for multiple bulky conventional compressed gas cylinders typically used for torch cutting. For the same reasons LOX is used in industrial applications, there is immense value in using LOX systems in tactical environments. A tactical team may need to enter a barricaded passageway or gain access through a heavily fortified door. Non-LOX systems may not provide the required length of cutting time or may require excessive quantities of fuel, which is an unrealistic option in tactical or mobile applications. The weight of commercially available industrial LOX tanks makes transportation to remote locations nearly impossible. Current commercial LOX systems' transportation generally requires large truck beds or tractor trailers.

In addition to being large and bulky systems, as a function of their limited internal volume between the reservoir and outer shell, many of the existent LOX packages provide flowrates only designed for more traditional low consumption functions (medical breathing, oxy-acetylene cutting), and not cases where rapid cutting by exothermic means could mean the difference between mission success and failure or the difference between life and death.

What is needed is a modular LOX system that allows for ease of transportation and also offers a very high-volume flow rate for extended rapid exothermic cutting operations. The modular system would offer the ability to carry multiple LOX supply units in support of one or more vaporizers for even greater extended torch-cutting capability.

SUMMARY

To minimize the limitations in the prior art, and to minimize other limitations that will become apparent upon reading and understanding the present specification, the present disclosure discloses a new and useful modular and transportable liquid oxygen exothermic cutting device.

The following presents a simplified overview of the example embodiments in order to provide a basic understanding of some embodiments of the example embodiments. This overview is not an extensive overview of the example embodiments. It is intended to neither identify key or critical elements of the example embodiments nor delineate the scope of the appended claims. Its sole purpose is to present some concepts of the example embodiments in a simplified form as a prelude to the more detailed description that is presented herein below. It is to be understood that both the following general description and the following detailed description are exemplary and explanatory only and are not restrictive.

Modular and transportable liquid oxygen exothermic cutting device is a transportable liquid oxygen cutting torch tool that uses oxygen and fuel gas to cut through materials, such as plate steel, also referred to as oxy-fuel cutting.

One embodiment may be a transportable liquid oxygen exothermic cutting device, comprising of one or more liquid oxygen supply, and one or more liquid oxygen vaporizers where each of the liquid oxygen supply units may be contained within a modular unit or frame assembly such that there may be one or more frame assemblies and the one or more liquid vaporizer units may be contained within a frame. One embodiment may include the liquid vaporizer in a modular unit or frame assembly. In another embodiment, the frame and frame assemblies may be stackable, or a modular form. In another embodiment, the frame assemblies may comprise an outer and inner frame that may matingly fit together. In yet another embodiment, the outer frames may be protective and rigid, and the inner frames may preferably dampen vibrations. In other embodiments, the liquid oxygen advanced exothermic support system may comprise one or more liquid oxygen supply units and one liquid oxygen vaporizer unit.

The problem with oxy-fuel torch cutting devices requiring large quantities of pressurized oxygen gas for remote or tactical operations is solved using a modular and transportable liquid oxygen exothermic cutting device.

One embodiment of the present disclosure may comprise one or more liquid oxygen ("LOX") containers, one or more vaporizers, and a cutting torch, which are operatively connected with various fittings, pipes, and hoses. The liquid oxygen containers may hold and/or contain oxygen in a cryogenic liquid state and supply the LOX to vaporizers that convert the LOX to oxygen gas. The oxygen gas may then be supplied to a torch, which may be combined with a fuel for exothermic cutting.

One embodiment of a modular transportable oxy-fuel cutting device may comprise: liquid oxygen containers; vaporizers; and a cutting torch; wherein the liquid oxygen containers, the vaporizers, and the cutting torch may all be in fluidic and operative communication with each other; wherein the liquid oxygen containers may be configured to contain a liquid oxygen fluid and supply the liquid oxygen fluid to the vaporizers; wherein the vaporizers may be configured to convert the liquid oxygen fluid to an oxygen gas; and wherein the cutting torch may be adapted to accept the oxygen gas and a fuel gas. The modular transportable oxy-fuel cutting device may further comprise a parallel dual liquid oxygen combining valve; wherein the parallel dual liquid oxygen combining valve may be configured to connect the liquid oxygen containers; and wherein the parallel dual liquid oxygen combining valve may be configured to maintain a constant flow and pressure of the liquid oxygen fluid from the liquid oxygen containers to the vaporizers. The parallel dual liquid oxygen combining valve may be configured to supply a flow rate of the liquid oxygen whereby a minimum flow rate of 9-16 standard cubic feet per minute (SCFM) of the oxygen gas may be converted. The modular transportable oxy-fuel cutting device may further comprise: flow modulators; and an oxygen gas pressure regulator; wherein the oxygen gas pressure regulator may be configured to (i) measure a pressure of the oxygen gas, (ii) measure a flow rate of the oxygen gas out of the vaporizers, and (iii) determine whether a vaporizer oxygen gas output alarm may be triggered; and wherein the flow modulators may be configured to reduce a flow of the liquid oxygen fluid to the vaporizers when the vaporizer oxygen gas output alarm may be triggered. The modular transportable oxy-fuel cutting device may further comprise: an oxygen gas combining valve; wherein the oxygen gas combining valve may be configured to accept a flow of the oxygen gas from the vaporizers and combine them to an output of the cutting torch. The oxygen gas combining valve may be configured to provide a minimum flow rate of 9-16 SCFM of the oxygen gas. The fuel gas may be selected from the group of fuel gases consisting of acetylene, propane, methylacetylene-propadiene propane (MAPP), propylene, natural gas, and combinations thereof. The modular transportable oxy-fuel cutting device may further comprise: a first liquid oxygen frame; and a first vaporizer frame; wherein at least a portion of the liquid oxygen containers may be substantially within and supported by the first liquid oxygen frame; wherein at least a portion of the vaporizers may be substantially within and supported by the first vaporizer frame; and wherein the first liquid oxygen frame and the first vaporizer frame may be configured to connect to each other. The first liquid oxygen frame may be configured to be stacked on or connected to a second liquid oxygen frame; and wherein the first vaporizer frame may be configured to be stacked on or connected to a second vaporizer frame. The first liquid oxygen frame may be configured to dampen vibrations; and wherein the first vaporizer frame may be configured to dampen the vibrations.

Another embodiment of a modular transportable oxy-fuel cutting device may comprise: liquid oxygen containers; vaporizers; a cutting torch; a parallel dual liquid oxygen combining valve; flow modulators; an oxygen gas pressure regulator; and an oxygen gas combining valve; wherein the liquid oxygen containers, the vaporizers, and the cutting torch may all be in fluidic and operative communication with each other; wherein the liquid oxygen containers may be configured to contain a liquid oxygen fluid and supply the liquid oxygen fluid to the vaporizers; wherein the vaporizers may be configured to convert the liquid oxygen fluid to an oxygen gas; wherein the cutting torch may be adapted to accept the oxygen gas and a fuel gas; wherein the parallel dual liquid oxygen combining valve may be configured to connect the liquid oxygen containers; wherein the parallel dual liquid oxygen combining valve may be configured to maintain a constant flow and pressure of the liquid oxygen fluid from the liquid oxygen containers to the vaporizers; wherein the oxygen gas pressure regulator may be configured to (i) measure a pressure of the oxygen gas, (ii) measure a flow rate of the oxygen gas out of the vaporizers, and (iii) determine whether a vaporizer oxygen gas output alarm may be triggered; wherein the flow modulators may be configured to reduce a flow of the liquid oxygen fluid to the vaporizers when the vaporizer oxygen gas output alarm may be triggered; wherein the oxygen gas combining valve may be configured to accept the flow of the oxygen gas from the vaporizers and combine them to an output of the cutting torch output; and wherein the liquid oxygen containers may be configured to be replaced individually while the liquid oxygen fluid may be still flowing. A modular transportable oxy-fuel cutting device may further comprise: a tactical vehicle frame module; wherein the liquid oxygen containers may be contained in the tactical vehicle frame module; and wherein the vaporizers may be contained in the tactical vehicle frame module. The tactical vehicle frame module may be configured to dampen vibrations. A modular transportable oxy-fuel cutting device may further comprise: a central processing unit; wherein the central processing unit may be configured to measure and process flow rate sensor data from flow rate sensors; wherein the central processing unit may be configured to determine whether the vaporizer oxygen gas output alarm may be triggered; and wherein the central processing unit may be configured to control the flow modulators. A modular transportable oxy-fuel cutting device may further comprise: a digital display; wherein the digital display may be configured to display a liquid oxygen level in the liquid oxygen containers; and wherein the digital display may be configured to display triggered alarms.

Another embodiment of a modular transportable oxy-fuel cutting device may comprise: liquid oxygen containers; vaporizers; a cutting torch; a parallel dual liquid oxygen combining valve; flow modulators; an oxygen gas pressure regulator; and an oxygen gas combining valve; wherein the liquid oxygen containers, the vaporizers, and the cutting torch may be all in fluidic and operative communication with each other; wherein the liquid oxygen containers may be configured to contain a liquid oxygen fluid and supply the liquid oxygen fluid to the vaporizers; wherein the vaporizers may be configured to convert the liquid oxygen fluid to an oxygen gas; wherein the cutting torch may be adapted to accept the oxygen gas and a fuel gas; wherein the parallel dual liquid oxygen combining valve may be configured to connect the liquid oxygen containers; wherein the parallel dual liquid oxygen combining valve may be configured to maintain a constant flow and pressure of the liquid oxygen fluid with liquid oxygen containers to the vaporizers; wherein the oxygen gas pressure regulator may be configured to (i) measure a pressure of the oxygen gas, (ii) measure a flow rate of the oxygen gas out of the vaporizers, and (iii) determine whether a vaporizer oxygen gas output alarm may be triggered; and wherein the flow modulators may be configured to reduce the liquid oxygen fluid to the vaporizers when the vaporizer oxygen gas output alarm may be triggered; wherein the oxygen gas combining valve may be configured to accept a flow of the oxygen gas from vaporizers and combine them to an output of the cutting torch. The parallel dual liquid oxygen combining valve may be configured to supply a flow rate of the liquid oxygen whereby flow rates greater than 16 SCFM of the oxygen gas may be converted. The oxygen gas combining valve may be configured to provide flow rates greater than 15 SCFM of the oxygen gas. A modular transportable oxy-fuel cutting device may further comprise: a tactical vehicle frame; wherein the liquid oxygen containers may be contained in the tactical vehicle frame; and wherein the vaporizers may be contained in the tactical vehicle frame. The tactical vehicle frame may be configured to dampen vibrations; wherein the liquid oxygen containers may be configured to be replaced individually while the liquid oxygen fluid may be still flowing.

It is an object to overcome the limitations of the prior art.

These, as well as other components, steps, features, objects, benefits, and advantages, will now become clear from a review of the following detailed description of illustrative embodiments, the accompanying drawings, and the claims.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps which are illustrated. When the same numeral appears in different drawings, it refers to the same or like components or steps.

DETAILED DESCRIPTION OF THE ILLUSTRATIVE EMBODIMENTS

Figure 1:
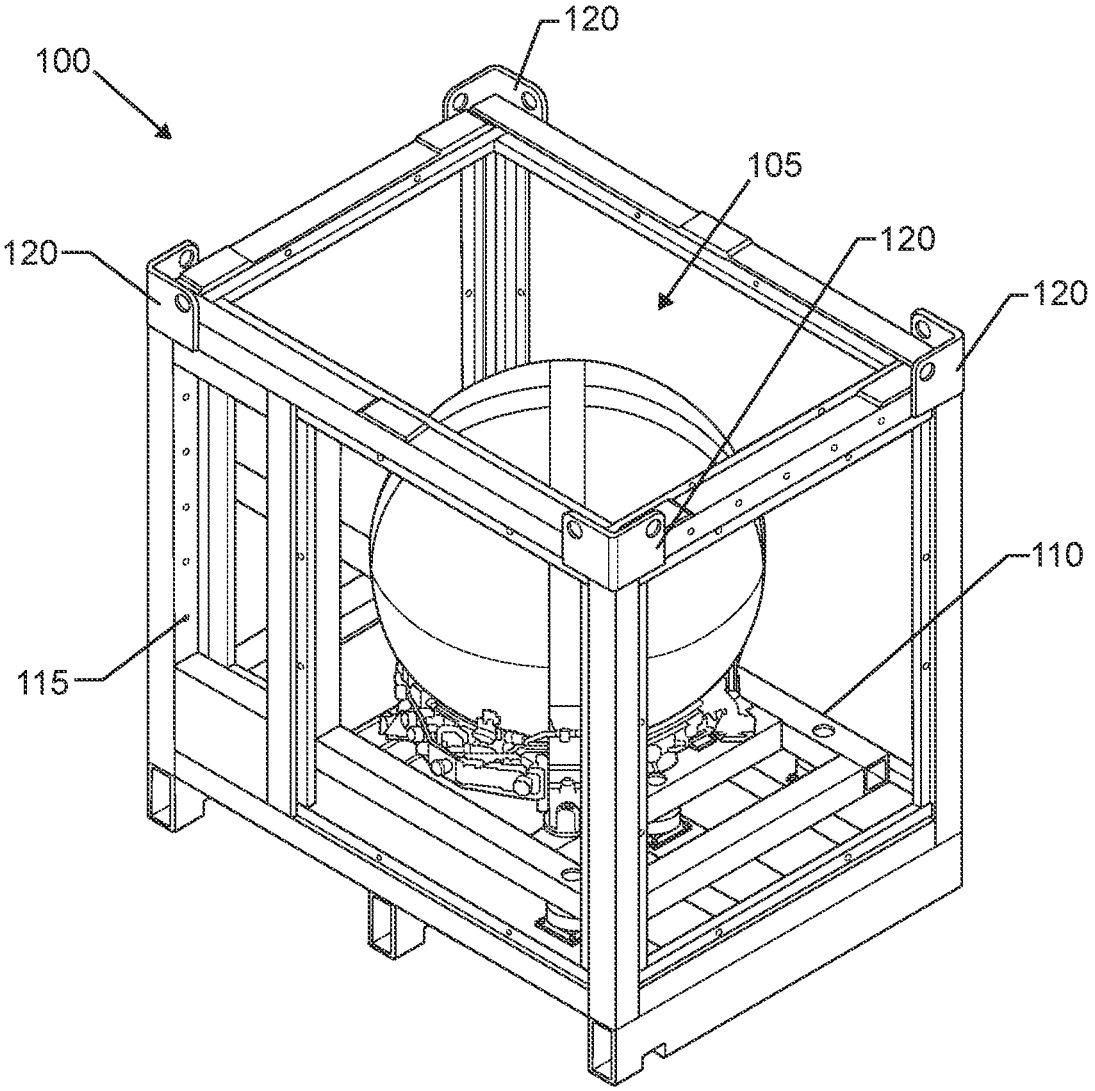
FIG. 1 is an illustration of one embodiment of the LOX frame assembly or module.

In the following detailed description of various embodiments of the present disclosure, numerous specific details are set forth in order to provide a thorough understanding of various aspects of one or more embodiments of the present disclosure. However, one or more embodiments of the present disclosure may be practiced without some or all of these specific details. In other instances, well-known methods, procedures, and/or components have not been described in detail so as not to unnecessarily obscure aspects of embodiments of the present disclosure.

While multiple embodiments are disclosed, still other embodiments of the devices, systems, and methods of the present disclosure will become apparent to those skilled in the art from the following detailed description, which shows and describes illustrative embodiments of the devices, systems, and methods of the present disclosure. As will be realized, the devices, systems, and methods of the present disclosure are capable of modifications in various obvious aspects, all without departing from the spirit and scope of the present disclosure. Accordingly, the screenshot figures, and the detailed descriptions thereof, are to be regarded as illustrative in nature and not restrictive. Also, the reference or non-reference to a particular embodiment of the devices, systems, and methods of the present disclosure shall not be interpreted to limit the scope of the present disclosure.

Before the present methods and systems are disclosed and described, it is to be understood that the methods and systems are not limited to specific methods, specific components, or to particular implementations. It is also to be understood that the terminology used herein is for the purpose of describing particular embodiments only and is not intended to be limiting.

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other components, integers, or steps. "Exemplary" means "an example of" and is not intended to convey an indication of a preferred or ideal embodiment. "Such as" is not used in a restrictive sense, but for explanatory purposes.

Disclosed are components that may be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all embodiments of this application including, but not limited to, steps in disclosed methods. Thus, if there are a variety of additional steps that may be performed it is understood that each of these additional steps may be performed with any specific embodiment or combination of embodiments of the disclosed methods.

The present methods and systems may be understood more readily by reference to the following detailed description of preferred embodiments and the examples included therein and to the Figures and their previous and following description.

In the following description, certain terminology is used to describe certain features of one or more embodiments. For purposes of the specification, unless otherwise specified, the term "substantially" refers to the complete or nearly complete extent or degree of an action, characteristic, property, state, structure, item, or result. For example, in one embodiment, an object that is "substantially" located within a housing would mean that the object is either completely within a housing or nearly completely within a housing. The exact allowable degree of deviation from absolute completeness may in some cases depend on the specific context. However, generally speaking, the nearness of completion will be so as to have the same overall result as if absolute and total completion were obtained. The use of "substantially" is also equally applicable when used in a negative connotation to refer to the complete or near complete lack of an action, characteristic, property, state, structure, item, or result.

In the following description, certain terminology is used to describe certain features of the various embodiments of the device, method, and/or system. For example, as used herein, the terms "computer" and "computer system" generally refer to any device that processes information with an integrated circuit chip and/or central processing unit (CPU).

As used herein, the terms "approximately" and "about" generally refer to a deviance of within 5% of the indicated number or range of numbers. In one embodiment, the term "approximately" and "about", may refer to a deviance of between 0.001-40% from the indicated number or range of numbers.

Various embodiments are now described with reference to the drawings. In the following description, for purposes of explanation, numerous specific details are set forth in order to provide a thorough understanding of one or more embodiments. It may be evident, however, that the various embodiments may be practiced without these specific details. In other instances, well-known structures and devices are shown in block diagram form to facilitate describing these embodiments.

As used herein, the term "central processing unit" or "CPU" refers to a complex set of electronic circuitries that interprets, processes, and executes instructions.

As used herein, the term "cutting torch" or "torch" refers to a blowpipe that uses a flame to preheat metal and then removes it with a jet of oxygen.

As used herein, the term "heat exchanger" refers to a device that transfers heat between two fluids at different temperatures.

As used herein, the term "liquid oxygen", "liquid oxygen fluid", or "LOX" refers to the liquid form of molecular oxygen ($O^2$).

As used herein, the term "oxy-fuel cutting" refers to a thermal cutting process that uses a mixture of oxygen and fuel gas to melt and cut materials, such as steel.

As used herein, the term "vaporizer" refers to a heat exchanger that converts cryogenic liquids and low-temperature fluids into a gaseous state by heating and/or vaporization.

As used herein, the term "vaporization" refers to converting a substance from the liquid or solid phase into the gaseous phase.

The modular transportable oxy-fuel cutting device of the present disclosure may be suitable for use in a heavy advanced entry environment, transportable on existing small vehicle platforms already in use with US Army Special Operations Forces (and other tactical vehicles in civilian and military use), that are of sufficient capability to support one cutting torch operator for a sustained cutting time of approximately 3 hours (equivalent consumption to 10 steel 'K' size cylinders of gaseous oxygen.

The present disclosure's modular transportable oxy-fuel cutting device may comprise a protective frame-mounted LOX vaporizer/heat exchanger system and one or more separate protective frame-mounted LOX supply unit(s). LOX supply unit frames may have a vibration-dampening sub-frame to isolate the LOX container from shock.

Exothermic cutting uses a significant volume of compressed oxygen gas, and the steel cylinders that contain that compressed oxygen are bulky and heavy. The modular transportable oxy-fuel cutting device of the present disclosure may provide more oxygen from a smaller footprint with less ancillary weight at a high enough flow rate (32 cubic feet per minute) that may support up to two operators cutting simultaneously using ½" inch diameter cutting rods. By comparison, the smallest self-contained commercial LOX system (180 Liter; 580 pounds ("lbs.") full weight) only flows six cubic feet per minute due to the limited size of its internal vaporizer.

Typical commercial Mega Cylinders are 45"×45"×76" and weigh 2,650 lbs. empty (4,340 lbs. full) and may be limited to 16 cubic feet per minute on half the flow rate of the modular transportable oxy-fuel cutting device of the present disclosure.

FIG. 1 is an illustration of one embodiment of the LOX frame assembly. Liquid oxygen ("LOX") frame assembly or module 100 may comprise a LOX container 105, LOX frame mount 110, LOX frame mounting holes 115, and LOX frame modular mounting plates 120.

Figure 2:
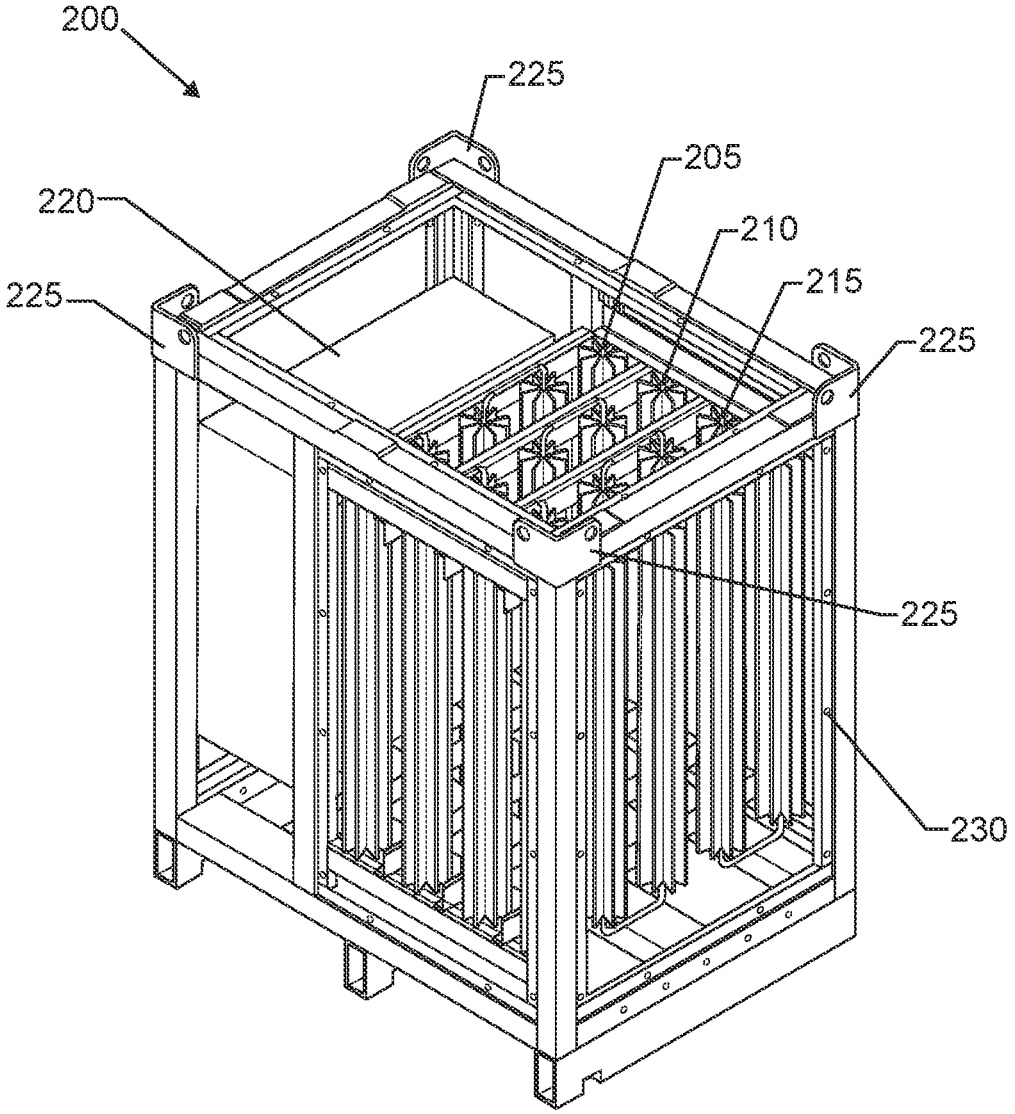
FIG. 2 is an illustration of one embodiment of a LOX vaporizer frame assembly or module.

LOX frame module 100 may be a rigid or semi-rigid outer frame and may preferably be configured to be shock absorbing. LOX frame module 100 may also be configured to modularly connect to one or more additional LOX frame assemblies and/or vaporizer frame modules 200, as shown in FIG. 2, using LOX frame mounting holes 115 and/or other connection devices. LOX frame module 100 may be stacked the other modules/assemblies and/or locked into place using LOX frame modular mounting plates 120. LOX frame module 100 may be configured to accept the removable or permanent installation of LOX container 105, which may preferably be rail-mounted liquid oxygen containers. LOX frame module 100 may also have LOX frame mount 110, which may preferably be vibration absorbing and allow for quick connect and disconnect of LOX container 105 within frame mount 110. A quick disconnect feature to LOX frame mount 110 may allow for quick replacement of LOX container 105.

LOX container 105 may preferably a rail-mounted liquid oxygen container that can contain approximately 2.64 gallons of LOX and supply up to 304 gaseous liters of oxygen at 70 pounds per square inch gauge ("psig"). But LOX container 105 may also be any liquid oxygen container suitable to safely contain the LOX.

In one embodiment, LOX frame module 100 and LOX frame mount 110 may be configured to accept a trolley-mounted liquid oxygen, a portable liquid oxygen system, or any other LOX container available in any particular region.

In one embodiment, LOX frame module 100 may be sized to allow the devices to be transported by many different types of military and tactical civilian vehicles. One such vehicle may preferably be a Polaris MRZR, which is an ultralight all-terrain vehicle commonly used in tactical military operations. LOX frame module 100 may preferably be transported on the back of vehicles, such as the Polaris, with the tailgate closed. The flow rate provided by the LOX supply unit may preferably be capable of supporting two operators simultaneously using ½-inch-diameter cutting rods with more than 30 $ft^3$/min of oxygen gas. The capacity will preferably be such that one cutting torch operator may perform sustained cutting for approximately three hours. Such a capacity may be equivalent to 10 steel K-type gaseous oxygen cylinders. LOX container 105 should preferably conform to relevant military Specifications for portable liquid oxygen containers.

FIG. 2 is an illustration of one embodiment of a LOX vaporizer frame assembly. Vaporizer frame module 200 may comprise first vaporizer 205, second vaporizer 210, third vaporizer 215, heat exchanger 220, vaporizer frame modular mounting plate 225, and vaporizer mounting holes 230.

Vaporizer frame module 200 may have a rigid or semi-rigid outer frame and may preferably be configured to be shock absorbing. Vaporizer frame module 200 may also be configured to modularly connect to one or more additional vaporizer frame modules 200 and one or more LOX frame modules 100, as shown in FIG. 1, using, for example, vaporizer frame mounting holes 230. Vaporizer frame modules 200 may be stacked on top of each other and locked into place using vaporizer frame modular mounting plates 225. Vaporizer frame module 200 may be configured to have one or more vaporizers and/or a heat exchanger installed. As shown in FIG. 2, vaporizer frame module 200 may comprise first vaporizer 205, second vaporizer 210, and third vaporizer 215 but should not be limited to three vaporizers or any specific number of vaporizers.

First vaporizer 205, second vaporizer 210, and third vaporizer 215 may preferably be similar vaporizers. First vaporizer 205, second vaporizer 210, and third vaporizer 215 may be operatively connected in series to allow liquid oxygen ("LOX") flow inline from (and/or to first vaporizer 205, second vaporizer 210, and third vaporizer 215. First vaporizer 205, second vaporizer 210, and third vaporizer 215 connected in series may allow for a greater increase in absorbed heat from the fins of first vaporizer 205, second vaporizer 210, and third vaporizer 215. First vaporizer 205, second vaporizer 210, and third vaporizer 215 may also be connected in parallel to allow for a greater flow and conversion of LOX to gas but at a lower increase in temperature. First vaporizer 205, second vaporizer 210, and third vaporizer 215 may be connected in a combination of series and parallel connections to maximize LOX conversion and an increase in temperature. First vaporizer 205, second vaporizer 210, and third vaporizer 215 may typically be ambient finned tube vaporizer, as shown. The fins may absorb the warm ambient air and transfer the heat to the cryogenic liquid flowing in the tube. The heat transfer converts the liquid oxygen into a gas. Ice may accumulate on the outer surfaces of first vaporizer 205, second vaporizer 210, and third vaporizer 215.

Heat exchanger 220 may be a LOX heat exchanger. A LOX heat exchanger may preferably warm liquid or gaseous oxygen to within 20 degrees of the ambient temperature before being output. Heat exchanger 220 may preferably consist of two paralleled heat exchanger coils, which may provide maximum converted gas expansion. A single output from heat exchanger 220 may preferably connect to a gas pressure regulator, as shown in FIG. 4.

Figure 4:
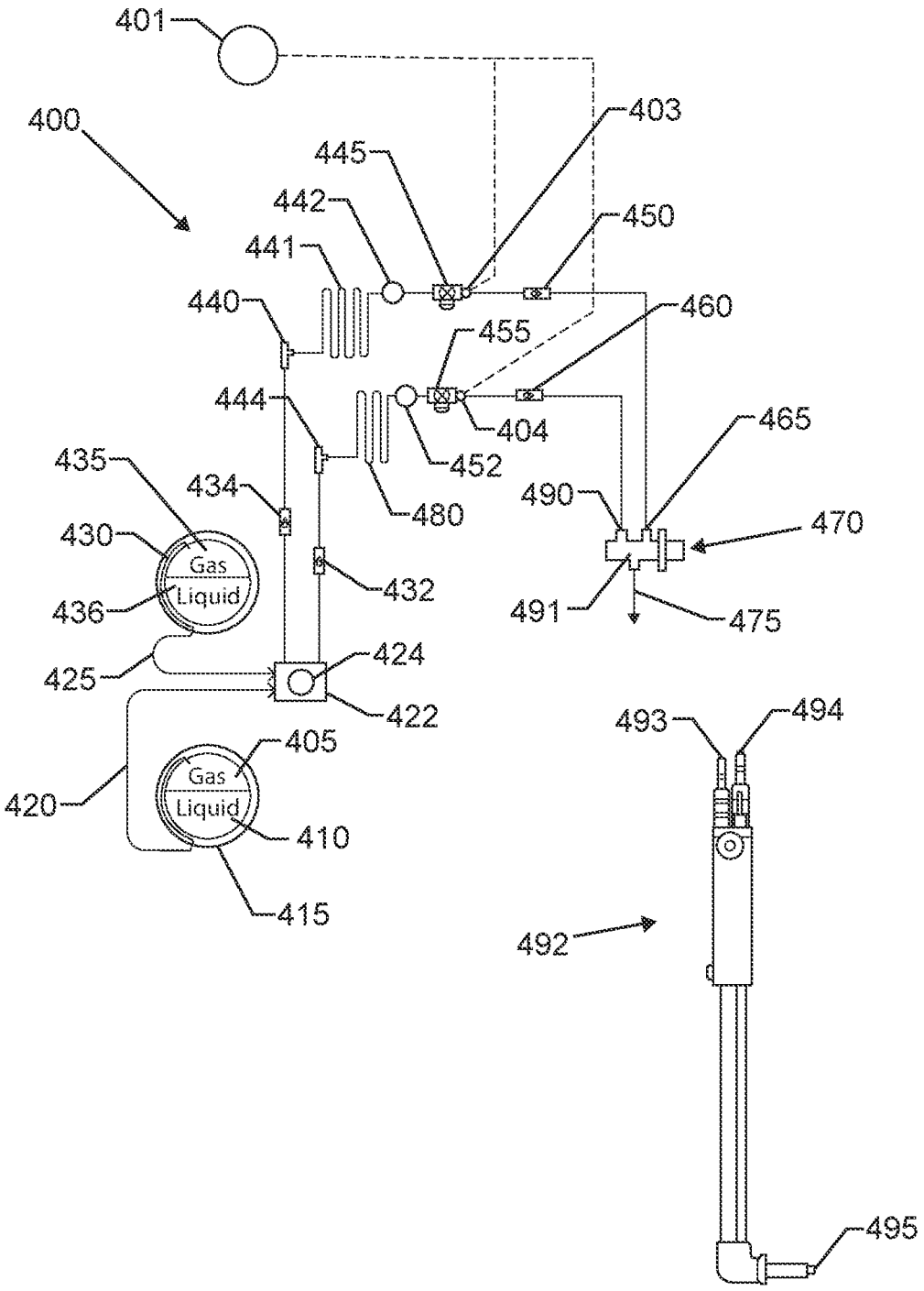
FIG. 4 is a schematic diagram of oxygen flow through a transportable oxy-fuel cutting device.

For maximum output of heat exchanger 220, first vaporizer 205, second vaporizer 210, and third vaporizer 215 may preferably accept parallel LOX container connections as shown in FIG. 4.

Figure 3:
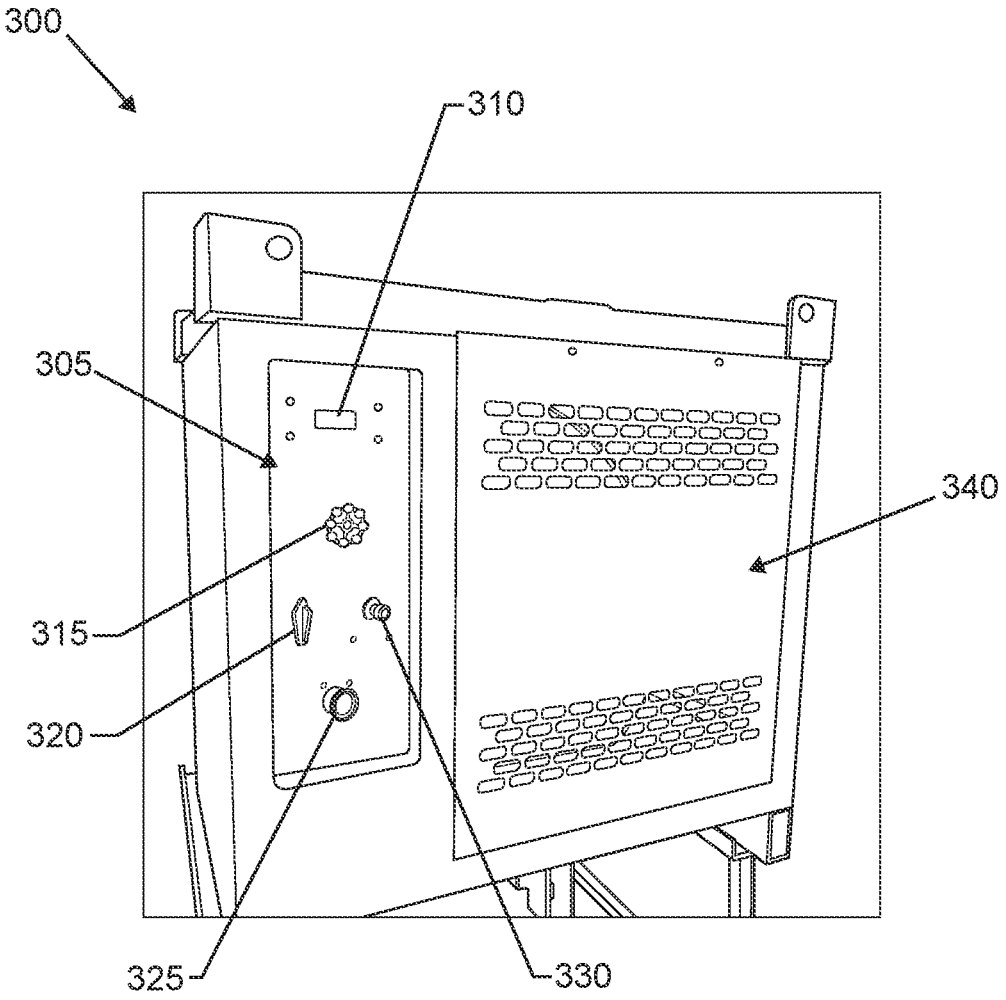
FIG. 3 is an illustration of a front view of one embodiment of the LOX frame assembly or module.

FIG. 3 is an illustration of a front view of one embodiment of the LOX frame assembly. LOX frame module 300 may comprise modular transportable oxy-fuel cutting connection and control panel 305 and LOX frame module front panel 340. Control panel 305 may comprise display 310, which may be digital (as shown) or analog, LOX flow valve 315, flow shut off valve 320, pressure vent 325, and LOX output 330. Digital display 310 may give an operator or user an indication of the remaining contents of the LOX container, which is behind panel 340, as a percentage of remaining contents. LOX flow valve 315 may be manual, digital, ball, gate, or electronically controlled valve. LOX flow valve 315 may allow an operator or user to variably control the flow rate of LOX output by LOX container (not shown). Flow shut-off valve 320 may be an instantaneous shut-off valve capable of stopping all LOX output. Pressure vent 325 may vent output for pressure ventilation of LOX container (not shown).

Lox frame module front panel 340 may be a panel constructed to protect the LOX container (not shown) and protect any internal assemblies or subassemblies from any obstruction, projectile, or debris that may cause damage to the container. Lox frame module front panel 340 may be made from any material capable of protecting the internal assemblies and subassemblies, such as steel, aluminum, composite, or plastic.

In one embodiment, control panel 305 may further include a display capable of displaying the LOX flow rate, an estimated time of use based on the rate of use, and potential alarm of LOX leaks.

FIG. 4 is a schematic diagram of oxygen flow through a transportable oxy-fuel cutting device. Modular transportable oxy-fuel cutting device 400 may comprise one or more LOX containers 415, 430, one or more LOX inputs 420, 425, combiner splitter valve 422, one or more LOX modulator valves 432, 434, one or more pressure vents 440, 444, one or more evaporators 441, 480, one or more heat exchangers 442, 452, one or more pressure regulators 445, 455, one or more gas modulator valves 450, 460, combiner valve 491, oxygen gas output 475, and cutting torch 492.

LOX containers 415, 430 preferably contain LOX 410, 436 but may also contain oxygen gas 405, 435. LOX containers 415, 430 may be, but are not limited to, trolley-mounted liquid oxygen containers, portable liquid oxygen systems, rail mounted liquid oxygen containers, or any other LOX container available in a region. LOX containers 415, 430 may contain up to 2.64 gallons of LOX and may preferably be capable of supplying up to 304 gaseous liters of oxygen at 70 psig.

One or more LOX inputs 420, 425 may allow a user operator to carry multiple LOX containers 415, 430 and replace one or more LOX containers 415, 430 while continuously operating modular transportable oxy-fuel cutting device 400.

Combiner splitter valve 422 may be a valve that allows LOX containers 415, 430 to be simultaneously, separably, or jointly connected to a modular transportable oxy-fuel cutting device 400. Combiner splitter valve may also include LOX flow valve 424 that may allow a user operator to variably control the flow of LOX to modular transportable oxy-fuel cutting device 400.

LOX modulator valves 432, 434 may automatically control the flow of LOX to the evaporators based an amount of ice buildup on evaporators 441, 480 as determined by a reduction in oxygen gas produced.

Pressure vents 440, 444 may allow a user operator to vent excess LOX pressure out of modular transportable oxy-fuel cutting device 400.

Evaporators 441, 480 may typically be ambient finned tube vaporizers. The fins may absorb the warm ambient air and transfer the heat to the cryogenic liquid flowing in tubes. The heat transfer converts the liquid into a gas. Ice may accumulate on evaporators 441, 480. Evaporators 441, 480 may be connected in series to allow liquid oxygen ("LOX") to flow from vaporizer 441 to vaporizer 480. Although only two vaporizers 441, 480, are described in series, any number of vaporizers may be utilized in series to achieve a desired increase in temperature or limit the reduction in oxygen gas due to the effect of ice-building up on evaporators 441, 480. Evaporators 441, 480 may also be connected in parallel to allow for a greater flow and conversion of LOX to gas, but a parallel configuration may limit the increase in temperature. Evaporators 441, 480 may be connected in a combination of series and parallel connections to maximize LOX conversion and increase in temperature absorption.

Heat exchangers 442, 452 may warm liquid or gaseous oxygen to within 20 degrees of ambient temperature before being output. Heat exchangers 442, 452 may preferably consist of two paralleled heat exchanger coils, providing maximum converted gas expansion.

Pressure regulators 445, 455 may allow for automatic pressure regulation as oxygen gas pressure may vary. Pressure regulators 445, 455 may be configured with gas flow rate sensors 403, 404.

Gas modulator valves 450, 460 may automatically control and balance the flow of oxygen gas to combiner valve 491 as oxygen gas may vary out of evaporators 441, 480 based on the amount of ice buildup on evaporators 441, 480 as determined by a reduction in oxygen gas produced.

Combiner valve 491 may combine one or more outputs 465, 490 from one or more evaporators 441, 480 into a single output oxygen gas output 475. Oxygen flow valve 470 may allow a user operator to control the flow of oxygen gas output 475.

Cutting torch 492 may accept oxygen gas output 475 into O2 torch input 493 and a fuel gas into fuel torch input 494. Cutting torch 492 may combine a fuel gas where it may be ignited torch output 495. Fuel torch input 494 may accept a fuel gas such as acetylene, propane, methylacetylene-propadiene propane (MAPP), propylene, and/or natural gas or any combination thereof.

Modular transportable oxy-fuel cutting device 400 may provide oxygen gas output 475 a minimum of 9-16 Standard Cubic Feet per Minute (SCFM). Additional LOX containers 415, 430 and evaporators 441, 480, may increase flow rates.

Central processing unit 401 may process data, store data, output results, transmit commands to devices, coordinate control activity, and process flow rate sensors 403, 404. Flow rate sensors 403, 404 may provide central processing unit 401 an estimate rate of oxygen gas out of evaporators 441, 480.

Figure 5:
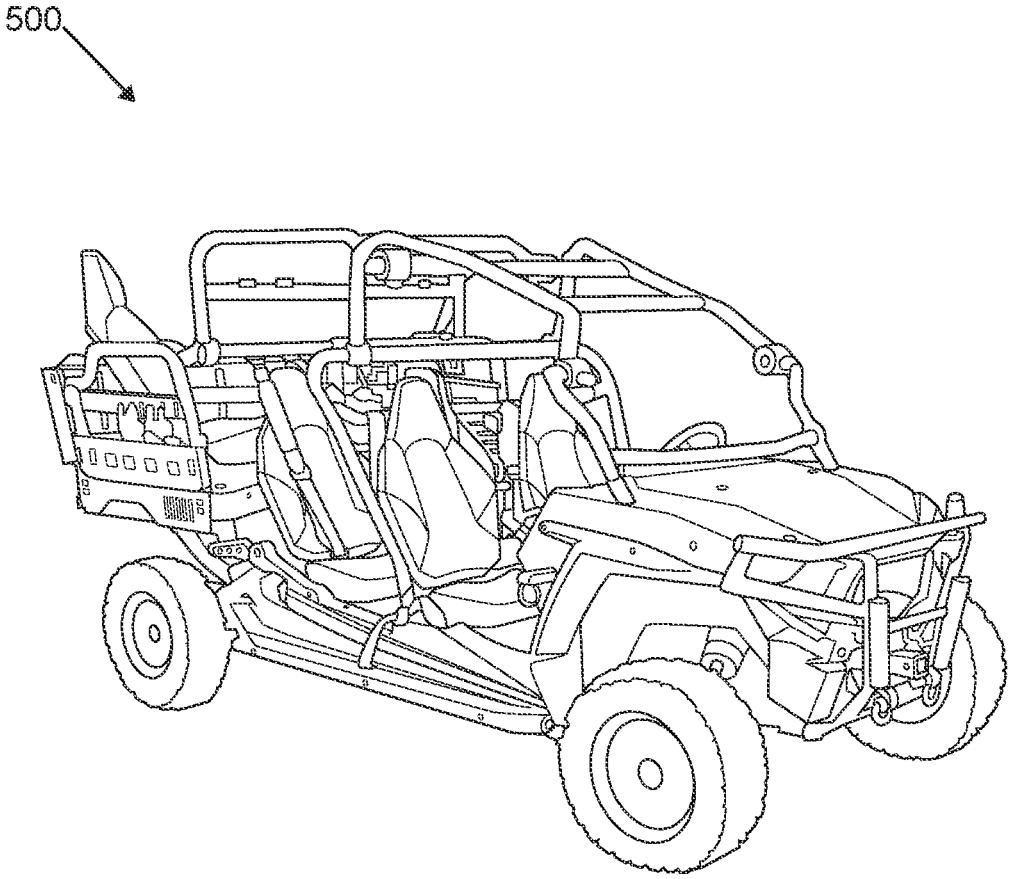
FIG. 5 is an illustration of a small military tactical vehicle that may transport the device of the present disclosure.

FIG. 5 is an illustration of a small military tactical vehicle that may transport the device of the present disclosure. All-terrain military tactical vehicle 500 may comprise a vehicle capable of transporting one or more persons with a modular transportable oxy-fuel cutting device of the present disclosure. Although a specific all-terrain military tactical vehicle 500 is depicted in FIG. 5, any type of vehicle, military vehicle, or tactical civilian vehicle may be used.

Figure 6:
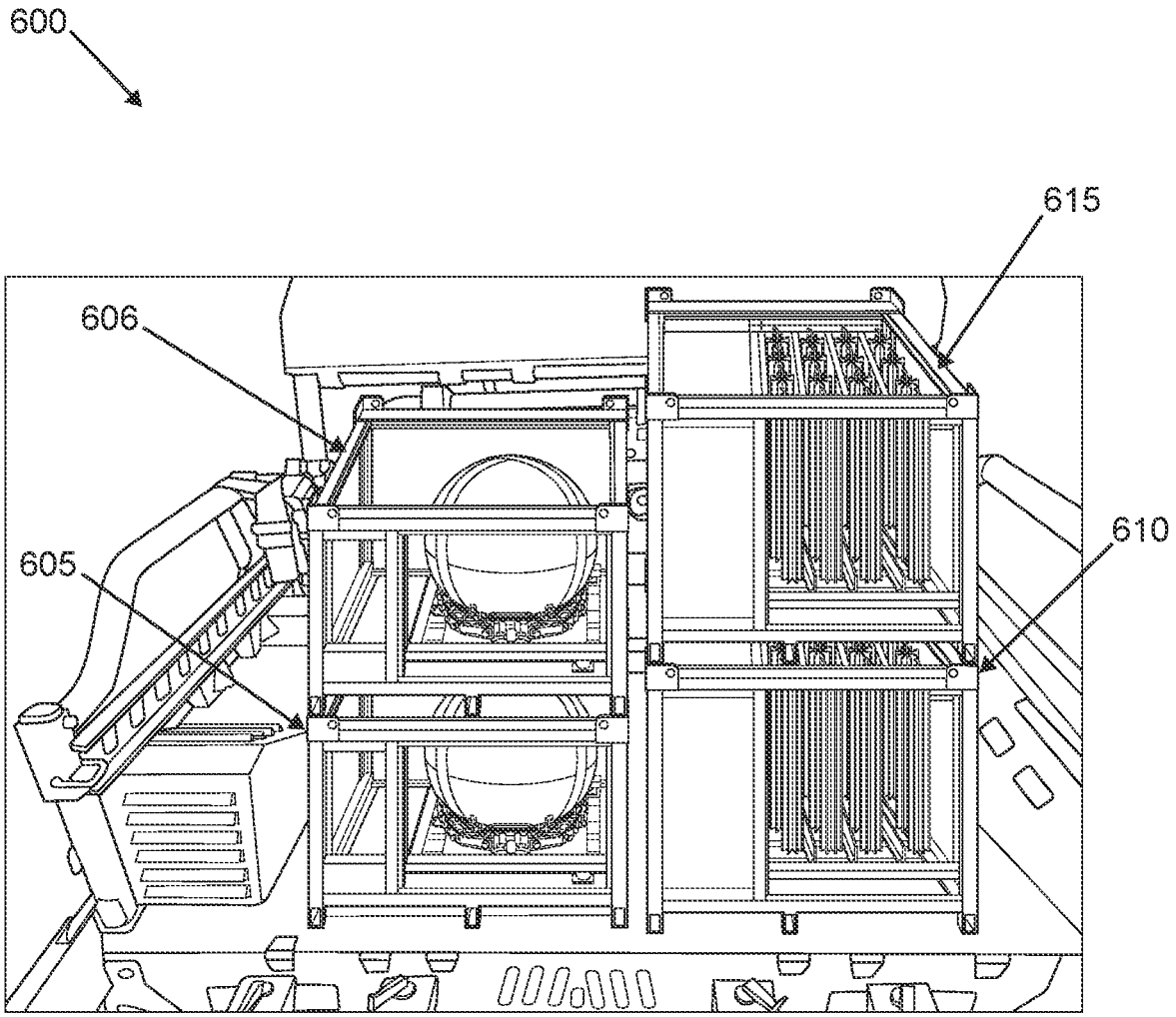
FIG. 6 is an illustration of the back of a tactical vehicle with a stacked LOX frame module and stacked vaporizer frame module installed, which allows for mobile transport of the device of the present disclosure.

FIG. 6 is an illustration of the back of a tactical vehicle with a stacked LOX frame module and stacked vaporizer frame module installed, which allows for mobile transport of the device of the present disclosure. All-terrain military tactical vehicle with a modular transportable oxy-fuel cutting device 600 may include one or more liquid oxygen frame modules 605 and one or more vaporizer frame modules 610. Liquid oxygen frame modules 605 and vaporizer frame modules 610 may be oriented in any manner and even stacked on top of each other. As shown in FIG. 6 liquid oxygen frame modules 606 may be stacked on liquid oxygen frame modules 605 and vaporizer frame modules 615 may be stacked on vaporizer frame modules 610. All-terrain military tactical vehicles with modular transportable oxy-fuel cutting device 600 may allow a modular transportable oxy-fuel cutting device to be transported and used in remote and distant locations. All-terrain military tactical vehicles with modular transportable oxy-fuel cutting device 600 may allow liquid oxygen frame modules 605 to replace LOX containers.

Unless otherwise stated, all measurements, values, ratings, positions, magnitudes, sizes, locations, and other specifications that are set forth in this specification, including in the claims that follow, are approximate, not exact. They are intended to have a reasonable range that is consistent with the functions to which they relate and with what is customary in the art to which they pertain.

The foregoing description of the preferred embodiment has been presented for the purposes of illustration and description. While multiple embodiments are disclosed, still other embodiments will become apparent to those skilled in the art from the above detailed description. These embodiments are capable of modifications in various obvious aspects, all without departing from the spirit and scope of protection. Accordingly, the detailed description is to be regarded as illustrative in nature and not restrictive. Also, although not explicitly recited, one or more embodiments may be practiced in combination or conjunction with one another. Furthermore, the reference or non-reference to a particular embodiment shall not be interpreted to limit the scope of protection. It is intended that the scope of protection not be limited by this detailed description, but by the claims and the equivalents to the claims that are appended hereto.

Except as stated immediately above, nothing that has been stated or illustrated is intended or should be interpreted to cause a dedication of any component, step, feature, object, benefit, advantage, or equivalent, to the public, regardless of whether it is or is not recited in the claims.

What is claimed is:

1. A modular transportable oxy-fuel cutting device, comprising:

more than one oxygen containers;

one or more vaporizers;

a cutting torch;

one or more flow modulators; and an oxygen gas pressure regulator;

wherein said more than one oxygen containers, said one or more vaporizers, and said cutting torch are all in fluidic and operative communication with each other;

wherein said more than one oxygen containers are configured to contain a liquid oxygen fluid and supply said liquid oxygen fluid to said one or more vaporizers;

wherein said one or more vaporizers are configured to convert said liquid oxygen fluid to an oxygen gas; and wherein said cutting torch is adapted to accept said oxygen gas and a fuel gas;

wherein said oxygen gas pressure regulator is configured to (i) measure a pressure of said oxygen gas, (ii) measure a flow rate of said oxygen gas out of said one or more vaporizers, and (iii) determine whether a vaporizer oxygen gas output alarm is triggered; and wherein said one or more flow modulators are configured to reduce a flow of said liquid oxygen fluid to said one or more vaporizers when said vaporizer oxygen gas output alarm is triggered.

2. The modular transportable oxy-fuel cutting device of claim 1, further comprising a combiner splitter valve;

wherein said combiner splitter valve is configured to connect said more than one oxygen containers to more than one LOX modulator valves; and wherein said combiner splitter valve is configured to maintain a constant flow and pressure of said liquid oxygen fluid from said more than one oxygen containers to said one or more vaporizers.

3. The modular transportable oxy-fuel cutting device of claim 1, further comprising:

an oxygen gas combining valve;

wherein said oxygen gas combining valve is configured to accept a flow of said oxygen gas from said one or more vaporizers and combine them to an output of said cutting torch.

4. The modular transportable oxy-fuel cutting device of claim 3, wherein said oxygen gas combining valve is configured to provide a minimum flow rate of 9-16 SCFM of said oxygen gas.

5. The modular transportable oxy-fuel cutting device of claim 1, wherein said fuel gas is selected from the group of fuel gases consisting of acetylene, propane, methylacetylene-propadiene propane (MAPP), propylene, natural gas, and combinations thereof.

6. The modular transportable oxy-fuel cutting device of claim 1, further comprising:

a first liquid oxygen frame; and a first vaporizer frame;

wherein at least a portion of said more than one oxygen containers are substantially within and supported by said first liquid oxygen frame;

wherein at least a portion of said one or more vaporizers are substantially within and supported by said first vaporizer frame; and wherein said first liquid oxygen frame and said first vaporizer frame are configured to connect to each other.

7. The modular transportable oxy-fuel cutting device of claim 6, wherein said first liquid oxygen frame is configured to be stacked on or connected to a second liquid oxygen frame; and wherein said first vaporizer frame is configured to be stacked on or connected to a second vaporizer frame.

8. The modular transportable oxy-fuel cutting device of claim 6, wherein said first liquid oxygen frame is configured to dampen vibrations; and wherein said first vaporizer frame is configured to dampen said vibrations.

9. A modular transportable oxy-fuel cutting device, comprising:

more than more than one oxygen containers;

one or more vaporizers;

a cutting torch;

a combiner splitter valve;

one or more flow modulators;

an oxygen gas pressure regulator; and an oxygen gas combining valve;

wherein said more than one oxygen containers, said one or more vaporizers, and said cutting torch are all in fluidic and operative communication with each other;

wherein said more than one oxygen containers are configured to contain a liquid oxygen fluid and supply said liquid oxygen fluid to said one or more vaporizers;

wherein said one or more vaporizers are configured to convert said liquid oxygen fluid to an oxygen gas;

wherein said cutting torch is adapted to accept said oxygen gas and a fuel gas;

wherein said combiner splitter valve is configured to connect said more than one oxygen containers to more than one LOX modulator valves;

wherein said combiner splitter valve is configured to maintain a constant flow and pressure of said liquid oxygen fluid from said more than one oxygen containers to said one or more vaporizers;

wherein said oxygen gas pressure regulator is configured to (i) measure a pressure of said oxygen gas, (ii) measure a flow rate of said oxygen gas out of said one or more vaporizers, and (iii) determine whether a vaporizer oxygen gas output alarm is triggered;

wherein said one or more flow modulators are configured to reduce a flow of said liquid oxygen fluid to said one or more vaporizers when said vaporizer oxygen gas output alarm is triggered;

wherein said oxygen gas combining valve is configured to accept the flow of said oxygen gas from said one or more vaporizers and combine them to an output of said cutting torch; and wherein said more than one oxygen containers are configured to be replaced individually while said liquid oxygen fluid is still flowing.

10. The modular transportable oxy-fuel cutting device of claim 9, further comprising:

a tactical vehicle frame module;

wherein said more than one oxygen containers are contained in said tactical vehicle frame module; and wherein said one or more vaporizers are contained in said tactical vehicle frame module.

11. The modular transportable oxy-fuel cutting device of claim 10, wherein said tactical vehicle frame module is configured to dampen vibrations.

12. The modular transportable oxy-fuel cutting device of claim 9, further comprising:

a central processing unit;

wherein said central processing unit is configured to measure and process flow rate sensor data from one or more flow rate sensors;

wherein said central processing unit is configured to determine whether said vaporizer oxygen gas output alarm is triggered; and wherein said central processing unit is configured to control said one or more flow modulators.

13. The modular transportable oxy-fuel cutting device of claim 9, further comprising:

a digital display;

wherein said digital display is configured to display a liquid oxygen level in said more than one oxygen containers; and wherein said digital display is configured to display triggered alarms.

14. A modular transportable oxy-fuel cutting device, comprising:

more than one oxygen containers;

one or more vaporizers;

a cutting torch;

a combiner splitter valve;

one or more flow modulators;

an oxygen gas pressure regulator; and an oxygen gas combining valve;

wherein said more than one oxygen containers, said one or more vaporizers, and said cutting torch are all in fluidic and operative communication with each other;

wherein said more than one oxygen containers are configured to contain a liquid oxygen fluid and supply said liquid oxygen fluid to said one or more vaporizers;

wherein said one or more vaporizers are configured to convert said liquid oxygen fluid to an oxygen gas;

wherein said cutting torch is adapted to accept said oxygen gas and a fuel gas;

wherein said combiner splitter valve is configured to connect said more than one oxygen containers;

wherein said combiner splitter valve is configured to maintain a constant flow and pressure of said liquid oxygen fluid with more than one oxygen containers to said one or more vaporizers;

wherein said oxygen gas pressure regulator is configured to (i) measure a pressure of said oxygen gas, (ii) measure a flow rate of said oxygen gas out of said one or more vaporizers, and (iii) determine whether a vaporizer oxygen gas output alarm is triggered; and wherein said one or more flow modulators are configured to reduce said liquid oxygen fluid to said one or more vaporizers when said vaporizer oxygen gas output alarm is triggered;

wherein said oxygen gas combining valve is configured to accept a flow of said oxygen gas from one or more vaporizers and combine them to an output of said cutting torch.

15. The modular transportable oxy-fuel cutting device of claim 14, wherein said oxygen gas combining valve is configured to provide flow rates greater than 15 SCFM of said oxygen gas.

16. The modular transportable oxy-fuel cutting device of claim 14, further comprising:

a tactical vehicle frame;

wherein said more than one oxygen containers may be contained in said tactical vehicle frame; and wherein said one or more vaporizers may be contained in said tactical vehicle frame.

17. The modular transportable oxy-fuel cutting device of claim 16, wherein said tactical vehicle frame is configured to dampen vibrations;

wherein said more than one oxygen containers are configured to be replaced individually while said liquid oxygen fluid is still flowing.

* * * * *